United States Patent [19]

Lee

[11] Patent Number: 5,054,622

[45] Date of Patent: Oct. 8, 1991

[54] ROTATING CLOTHES HANGER AND ARTIFICIAL CHRISTMAS TREE

[76] Inventor: Kil J. Lee, Pacific Grove, Calif.

[21] Appl. No.: 578,085

[22] Filed: Sep. 5, 1990

[51] Int. Cl.[5] ..... A47F 5/00

[52] U.S. Cl. ..... 211/2; 211/196; 211/205

[58] Field of Search ..... 211/205, 196, 2, 163

[56] References Cited

U.S. PATENT DOCUMENTS

| | | | |
|---|---|---|---|
| 346,293 | 7/1886 | Lavaggi . | |
| 381,414 | 4/1888 | Parker . | |
| 478,386 | 7/1892 | Wolf . | |
| 649,734 | 5/1900 | Leger . | |
| 922,991 | 5/1909 | Wolf . | |
| 3,315,819 | 4/1967 | Kingsbery . | |
| 4,291,075 | 9/1981 | Puleo | 211/205 X |
| 4,343,842 | 8/1982 | Chase | 211/205 X |
| 4,774,113 | 9/1988 | Shaffer | 211/205 X |
| 4,789,570 | 12/1988 | Maddock | 211/205 X |
| 4,897,292 | 1/1990 | Glickman | 211/205 X |

*Primary Examiner*—Robert W. Gibson, Jr.
*Attorney, Agent, or Firm*—William H. Pavitt, Jr.

[57] ABSTRACT

A clothes stand formed of an orified vertical base member which supports an upstanding axle on which are mounted a plurality of rotatable clothes support members, is convertable into a Christmas tree by removing the axle and clothes support members from the orifice in the base member and replacing them with an element insertable in the orifice which serves to support a vertically orificed tubular shaft of a smaller size than the axle, and on which shaft are mounted a series of annular elements from each of which extend a plurality of needled branches of such lengths as to simulate the tapered appearance of a Christmas pine tree. After serving as a Christmas tree, it may be converted back to a clothes stand by replacing the support element shaft and annular elements with the axle and clothes support members.

1 Claim, 3 Drawing Sheets

ROTATING CLOTHES HANGER AND ARTIFICIAL CHRISTMAS TREE

Prior Art, Objects and Summary of the Invention

The present invention represents a utilization of the clothes tree which is disclosed and claimed in my U.S. Pat. No. 4,889,246 issued Dec. 26, 1989, and a modification of the type of convertible clothes tree which is the subject of my U.S. Pat. No. 4,877,140 issued Oct. 31, 1989. Reference is made to these two patents for a listing of known prior art, the objects of such inventions, the structure of the clothes tree and the manner in which the clothes tree itself operates.

According to the present invention, when the clothes tree of U.S. Pat. No. 4,889,246 is to be converted to a Christmas tree, instead of utilizing the axle rod and spool-like elements with their support arms and annular member, as disclosed and claimed in U.S. Pat. No. 4,877,140, everything above the base member of the clothes tree of those patents is temporarily removed; and several elements which, when assembled, form a simulated pine tree are mounted on the base member by means of a thin tubular shaft, the lower end of which may be anchored in a supporting stem inserted into the orifice of the base member. Each element may comprise a trunk segment from which a plurality of needled branches may extend upwardly and angularly about its circumference and is separated from adjacent segments by cylindrical spacers slidable on the tubular shaft. At least one end of each segment is engageable with an end of an adjacent spacer. The lowermost element may interlock with the top of the supporting stem inserted in the orifice in the base member and protruding upwardly therefrom. Desirably, at least three, and as many as seven or eight such trunk like segments should be provided to form the simulated tree.

It is also a feature of the present invention that the branches extending from each trunk segment desirably are pivotable between an angle of approximately 70 degrees relative to the trunk segment, and an angle of 20 degrees.

When disposed at the latter angle, the segment with its needled branches may be brought together more tightly about the trunk portion for shipping and storage. However, when set up to simulate a tree, the branches would be opened up to the 70 degree angle.

Various means may be employed to enable such pivoting of the branches to be accomplished, e.g. each branch may be formed about a wire core, an end of which wire may be pivotably mounted at point on the trunk segment.

Preferably, a needled wire may be bent back upon itself and the bend may be looped over a projection extending from the trunk segment, and retainer means provided to restrict the movement of the bent portion of the wire to the desired swing angle about the projection.

It would also be possible to provide an electrical cord which could be passed up through the tubular shaft to the top of the tree for illuminating one or more bulbs there disposed.

With the passage of the Christmas season, the converting elements of the present invention may be removed from the base member and replaced with the axle rod and spool-like elements and spacers to reconstitute the clothes tree of U.S. Pat. No. 4,889,246.

Description of the Drawings

In the accompanying drawings.

Description of the Preferred Embodiment

Figure 1:
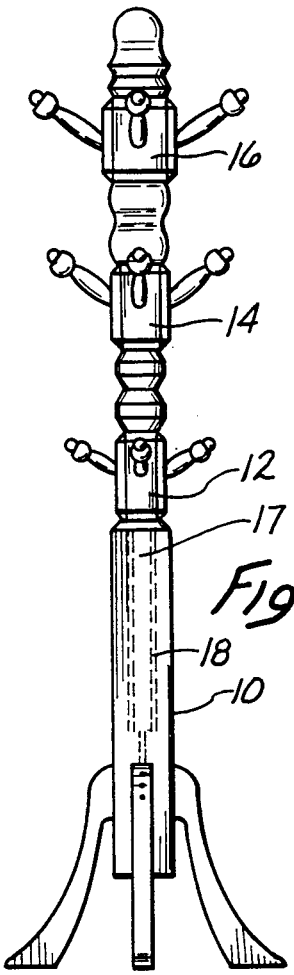
FIG. 1 is an elevational view of the clothes tree stand.
Figure 2:
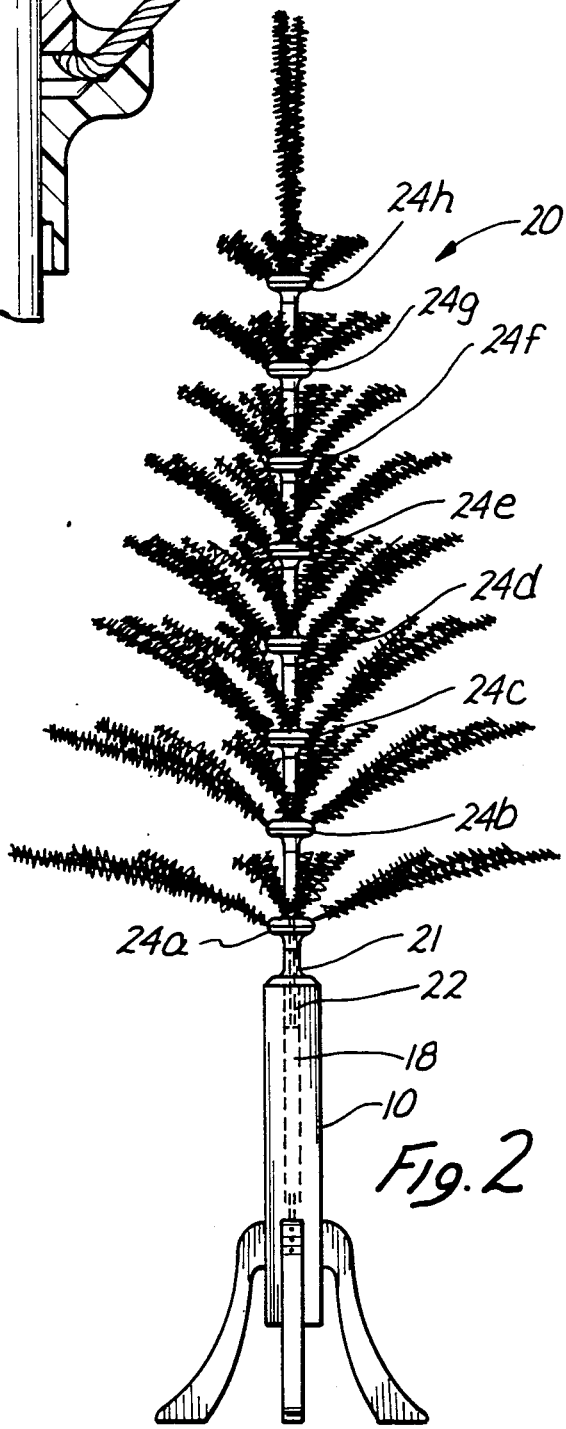
FIG. 2 is an elevational view of the stand converted to carry a simulated Christmas tree.
Figure 7:
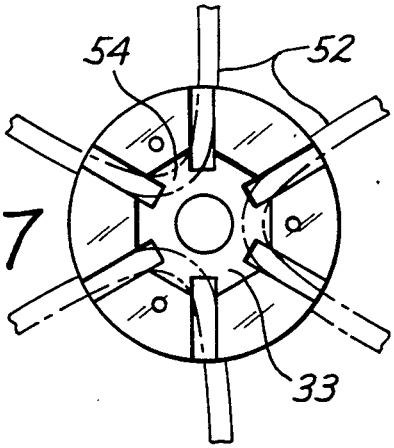
FIG. 7 is an axial view on the line 7—7 of FIG. 4 seen in the direction of the arrows.

In FIG. 1 of the accompanying drawings, there is illustrated the basic clothes stand of my prior U.S. Pat. Nos. 4,877,140 and 4,889,246. FIG. 2 shows the result of converting the stand of FIG. 1 to a Christmas tree in accordance with the present invention.

The clothes stand basically comprises a base member 10 on top of which are mounted a plurality of coat hanging members 12, 14 and 16 by means of which an axle rod 17 which extends down into an axial bore or orifice 18 in at least the top of the base member 10. To affect the conversion according to the present invention, the axle rod 17 and the several elements 12, 14 and 16 supported by it are all removed and, in lieu thereof, the tree designated generally as 20 is mounted on the stand 10 in the manner hereinafter described.

Figure 3:
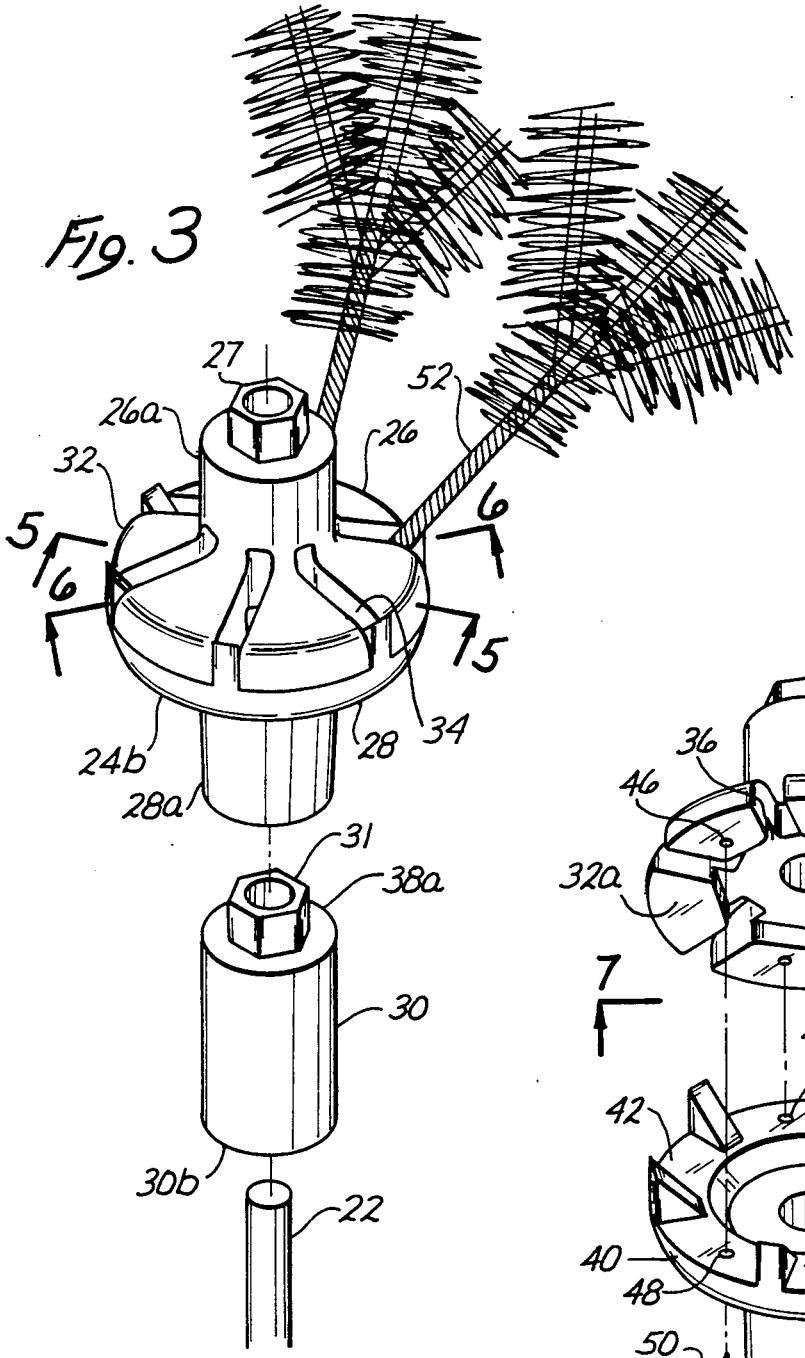
FIG. 3 is an exploded enlarged perspective view of the next-to-uppermost branch carrying segment.
Figure 4:
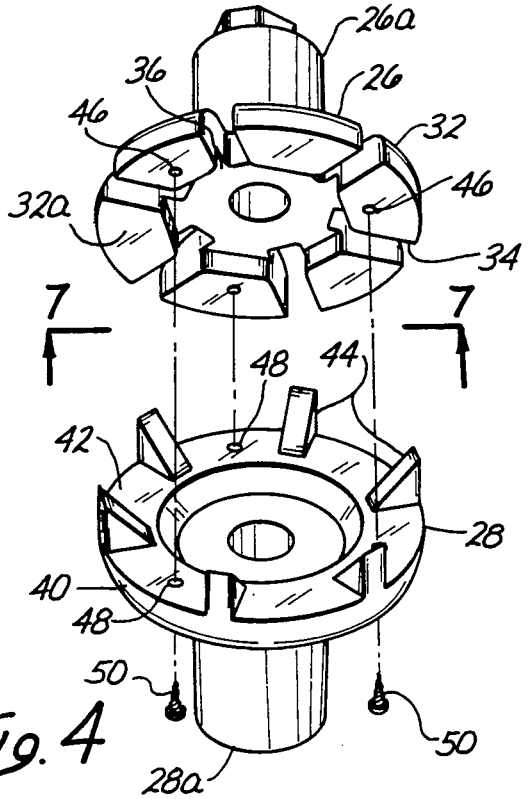
FIG. 4 is an exploded perspective view of the branch carrying segment shown in FIG. 3.
Figure 5:
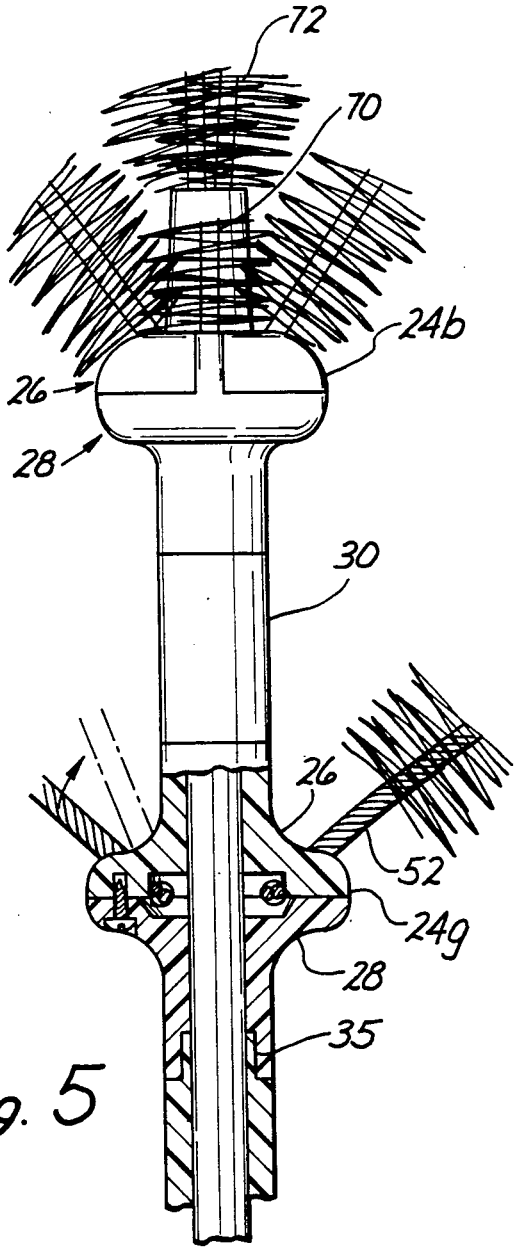
FIG. 5 is a partial side elevation of the top and adjacent lower segments, with the latter shown in part section on the line 5—5 of FIG. 3, and looking in the direction of the arrows.

In one embodiment of the invention, a sleeve-like preferably plastic base retainer 21 adapted to support a smaller diameter tubular element 22 is provided for insertion into the orifice 18 similar to the manner in which the base of the axle rod 17 was provided in FIG. 1. There is then slipped over this element 22 a plurality of branch carrying segments **24*a*, 24*b*, 24*c*, 24*d*, 24*e*, 24*f*, 24*g*, and 24*h*, each of which is separated from adjacent segments by a cylindrical spacer 30. One of such segments 24*b* and a spacer 30 is shown in FIG. 3 and two segments 24*g*, 24*h*, assembled with spacers 30 is shown in FIG. 5**.

Referring to FIGS. 3–8, it may be seen that each segment may be comprised of an upper portion 26 and a lower portion 28. The two portions 26, 28 and each spacer element 30 desirably may be molded of a plastic, such as polypropylene, and in a green color to match the needles 29, or in the brown color of a tree trunk. The upper portion 26 is formed at its base with a plurality of pie shaped radially extending wedges 32, each of which is spaced at 34 as a slot, from each of its two adjacent wedges 32. The lower inside area of each wedge, however, is recessed at 36 so that it does not extend all the way to coincide with the upper cylindrical portion **26*a***.

Figure 6:
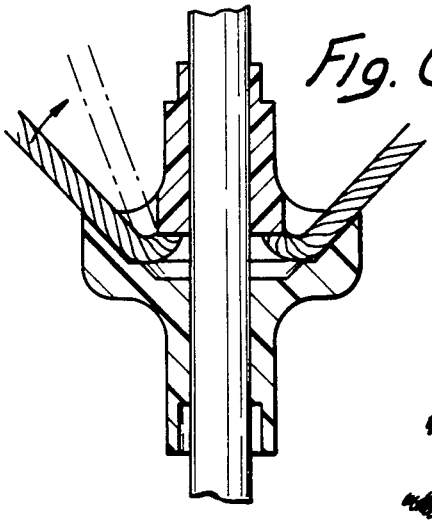
FIG. 6 is a section taken on the line 6—6 of FIG. 3 looking in the direction of the arrows.

The lower portion 28 is matingly formed of a cylindrical section **28*a* the upper part of which flairs out to provide an annular upper seat 40, from the upper face 42 of which project a plurality of equally spaced apart right triangular blocks 44 of such size as to fit between each of the slots 34 in the upper portion 26 of the segment. Orifices 46 are provided to extend partially into the under sides 32***a* of several of the wedges 32, and orifices 48 aligned in register with the orifices 46, are provided in the annular seat 40 of the lower portion 32. Thereby screws 50 may be employed to secure together in interlocking engagement the upper portion 26 with the lower portion 28. However, before this joinder is affected, a plurality of needle bearing wires 52 are bent back on each other to form a U-shape 54 (FIG. 7) and passed between the slots 34 of each wedge 32 and through the recess 36. Thereby the bent wire 52 may be pivoted behind the underside 32*a* of the wedge 32, and secured against removal and in such pivoting position, when the lower portion 28 is brought against the upper portion 26, and both are secured together by the screws 50 through the holes 48 and in the orifices 46. The manner in which the upper and lower portions 26, 28 are secured together is best shown in FIGS. 5 and 6. Thus mounted, the needle bearing wires 52 may be pivoted between a point as closely parallel to the axis of the segments 24*a*–24*h* as the needles on the wire may allow and an angle determined by the angle of the hypotenuse of the triangular blocks 44.

Each spacer 30 is preferably formed as a hollow cylindrical body having an outside diameter of the same dimension as that of the cylindrical portions 26*a* and 28*a* of the upper and lower portions of 26 and 28 respectively, of the several segments 24*a*–*i*, and an inside diameter of sufficient size to allow the tube 22 to be passed therethrough. On one end 30*a* a hexagonal nut 31 is molded in the same manner a similar type nut 27 is molded at the cylindrical end 26*a* of the upper portion of the segment of 24*b* (FIG. 3). The opposite end 30*b* is molded with a recess 33 of such shape and dimension as to enable the nut 27 molded on the upper portion 26 of the segment 24*b* to be received and matingly gripped thereby to prevent rotation of the spacers 30 and the segments 24*a*–*h* to be rotated relative to each other.

Corresponding to the recess 33 in the end 30*b* of the spacer 30 is a similarly dimensioned recess 35 in the bottom of the cylindrical portion 28*a* of each segment 24*a*–*h*, to receive the molded nut 31 on the end 30*a* of a spacer 30.

Figure 8:
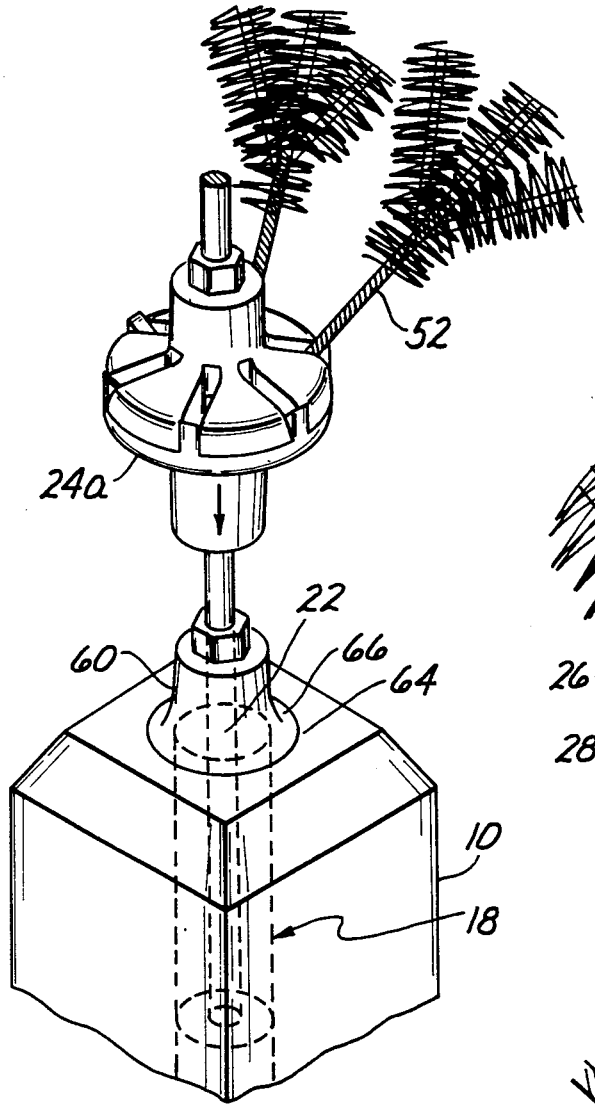
FIG. 8 is a perspective view of the base support member and first branch carrying segment as the latter is being slid down the tubular shaft.

Because the opening or bore 18 in stand 10 is of substantially greater diameter than that of the tube 22 a base support member 60 is molded to the configuration shown in FIG. 8—preferably of a rigid, but at least slightly resilient, plastic material. This base support member 60 is molded with an axial bore 64 of such a dimension as to receive in the firm fit the lower end of the tube 22. A flared flange or other annular projection 66 should be provided to prevent the member 60 from slipping down below the top of the stand orifice 18. Means should also be provided to prevent the tube 22 from sliding through the member 60. In addition, the outside of the support member 60 may be fluted to inhibit rotation of the tree relative to the stand.

A nut 67 similar to the nuts 27 and 31 on the upper portion 36 of the segments 24*a*–*g* and spacers 30 respectively, desirably is molded on the top 66*a* of the support member 60, for insertion into the recess 35 on the underside of the cylindrical portion 28*a* of the lower portion 28 of the segment 24*a*.

The uppermost segment 24*h* may differ from segments 24*a*–24*g* in that its upper half will not be configured in the manner of the latter segments, but may be tapered as shown in FIG. 5 at 70, and provided with a top tip branch 72.

Each of the segments 24*a*–24*h* would ordinarily be removed from the tube 22 and packed in a box together with the base support member 60 and all of the spacers 30. When it is desired to substitute a Christmas tree on the base stand 10 for the removed coat hanging members 12, 14 and 16. The base member 60 and the tube which may be held together, as by adhesive or by a tight fit, are first inserted into the orifice 18 in the stand 10, and then the segments 24*a*–24*h*, each separated by a spacer 30 are then dropped down the tube 22 seriatim, i.e. 24*a* with a larger branch is put on, followed a spacer 30; then segment 24*b* is put on, followed a spacer, and so forth, until the uppermost segment 24*h* with its spire branch 72 is dropped down on to the top of the tube 22, thereby to complete the tree.

After the Christmas season, the assembly process is reversed and the several segments 24*a*–*h* may be removed and packed in a box with the support member 60 and the rod 22 is then pulled out and packed away. The stand 10 is then ready to be reassembled as a clothes stand as shown in FIG. 1.

It may thus be seen that the present invention provides a clothes stand which may be easily converted to a Christmas tree for the brief Christmas season, and then reconverted back as a rotating clothes stand.

I claim:

1. A clothes stand convertible to a Christmas tree, said stand being of the type comprising:

(a) a base member, said member being at least partially axially orificed, from its top downwardly, said base member including means to support said base member on a horizontal surface with the axis of said orifice in a substantially vertical orientation;

(b) a cylindrical axle rod, said rod having a portion of a configuration to fit into the orifice in said base member, and being removably inserted therein;

(c) a plurality of spool-like elements disposed in series on said axle rod, each of said spool-like elements having an internal diameter slightly greater than the external diameter of said axle rod, thereby being rotatable about said axle rod, each of said spool-like elements being rotatable independently of the others;

(d) at least one support arm longitudinally extending angularly upwardly from each of said spool-like elements to support a coat or other garment therefrom; and (e) each spool-like element above the lowermost said element being of greater outside diameter than that immediately below it, and each support arm extending from the spool-like element above the lowermost such element, being of a greater longitudinal dimension than that of any of the arms extending from the spool-like element immediately below whereby garments placed on the several support arms on the different spool-like elements may be rotated about said axis for different angular dispositions relative to said rod, and garments hung on the upper support arms will not hang on the same vertical line as the garments hung on the lower support arms, so that garments hung on the support arm of any spool-like element may be rotated about the axle rod in a different concentric cylindrical path from that defined by the rotation of garments hung on the support arms of any other spool-like element;

wherein for conversion, upon removing said axle rod and said spool-like elements from the base member, there is provided a support shaft, means insertable into the orifice in said base member to provide vertical support for said shaft, and a plurality of elongated branch bearing trunk-like members, said trunk-like members being axially orificed to be mountable in series one above the other on said shaft, each of said trunk-like members having a plurality of needled branches extending angularly upwardly and the uppermost member being tipped in the manner of a Christmas tree.

* * * * *